US006357509B1

(12) United States Patent
Lamazares

(10) Patent No.: US 6,357,509 B1
(45) Date of Patent: Mar. 19, 2002

(54) SECURITY CLOSURE FOR DWELLING OPENINGS

(76) Inventor: Ladislao Lamazares, 1555 W. 44th Pl., Miami, FL (US) 33012

( * ) Notice: Subject to any disclaimer, the term of this patent is extended or adjusted under 35 U.S.C. 154(b) by 0 days.

(21) Appl. No.: 09/815,650

(22) Filed: Mar. 23, 2001

(51) Int. Cl.[7] ..... E05D 15/00

(52) U.S. Cl. ..... 160/210; 49/67; 49/56; 160/96

(58) Field of Search ..... 49/50, 56, 61, 49/63, 67, 163, 168; 60/210, 96, 40, 92, 97, 114, 131, 183, 351, 352

(56) References Cited

U.S. PATENT DOCUMENTS 2,455,112 A * 11/1948 Christison ..... 160/114
4,103,458 A * 8/1978 Booker ..... 49/56
4,589,463 A * 5/1986 Ryan ..... 160/88
4,644,688 A * 2/1987 Benderoff ..... 49/67
4,738,053 A * 4/1988 Biesenthal ..... 160/88
5,927,011 A * 7/1999 Sickenius ..... 49/56
6,164,013 A * 12/2000 Ramsey ..... 49/70

FOREIGN PATENT DOCUMENTS

GB 2147355 * 5/1985 ..... 49/56

* cited by examiner

*Primary Examiner*—Jerry Redman
(74) *Attorney, Agent, or Firm*—J. Sanchelima

(57) ABSTRACT

A security closure device to protect a building opening and a closure member. The device includes a main security panel and a narrower secondary security panel that are hingedly mounted to each other. The side of the main security panel opposite to the smaller security panel is hingedly mounted to a security casing assembly inside the building defining the protected opening. A user can readily unlock the narrower panel from the casing assembly from inside the building without requiring a key or combination. From the outside, a key or combination is required. To open the inwardly swinging security closure, a user opens the closure member a sufficient distance determined by the width of the secondary panel to unlock it. The angular travel of the secondary panel with respect to the main security panel is limited by a stopper assembly.

5 Claims, 2 Drawing Sheets

SECURITY CLOSURE FOR DWELLING OPENINGS

BACKGROUND OF THE INVENTION

1. Field of the Invention

The present invention relates to security closures, and more particularly, to a security closure that is installed inside a building's opening such as door or window openings.

2. Description of the Related Art

Many designs for security closures, including doors and windows, have been designed in the past. None of them, however, include a security door that is opened from inside a building. One of the advantages of mounting doors inside is to avoid the possibility of hitting a person outside when the door and security door are opened. The regular door opens inwardly while the security door opens outwardly.

It is desirable also to have a security door that opens inwardly in a building for security reasons. In case of an emergency, such as fire, a trapped dweller or visitor can readily open the security door from inside the building. Security doors today are mounted outside and they typically have a locking mechanism requiring a key. If no key locking mechanism is used then the security door can be opened by anyone. Thus the need to have it open from inside the building and inwardly.

Also, by having a security door mounted outside a regular door, a user opens the security door outwardly with the dangerous probability of hitting someone. Or, if an object is left in front of the security door, the dweller is trapped. Thus, the desirability of a door that opens inwardly and can also be readily accessed from the outside to unlock it.

SUMMARY OF THE INVENTION

It is one of the main objects of the present invention to provide a security closure for building openings that can be mounted inside a building's opening and that swings inwardly.

It is another object of this invention to provide a security closure that is safe to use avoiding the possibility of hitting a person outside or that an object could obstruct the opening of the security closure.

It is still another object of the present invention to provide a security door that can be readily unlocked by a user inside the building without requiring a key, equivalent device or combination lock, while preventing outsiders to actuate the locking mechanism without a key, equivalent device or combination lock.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
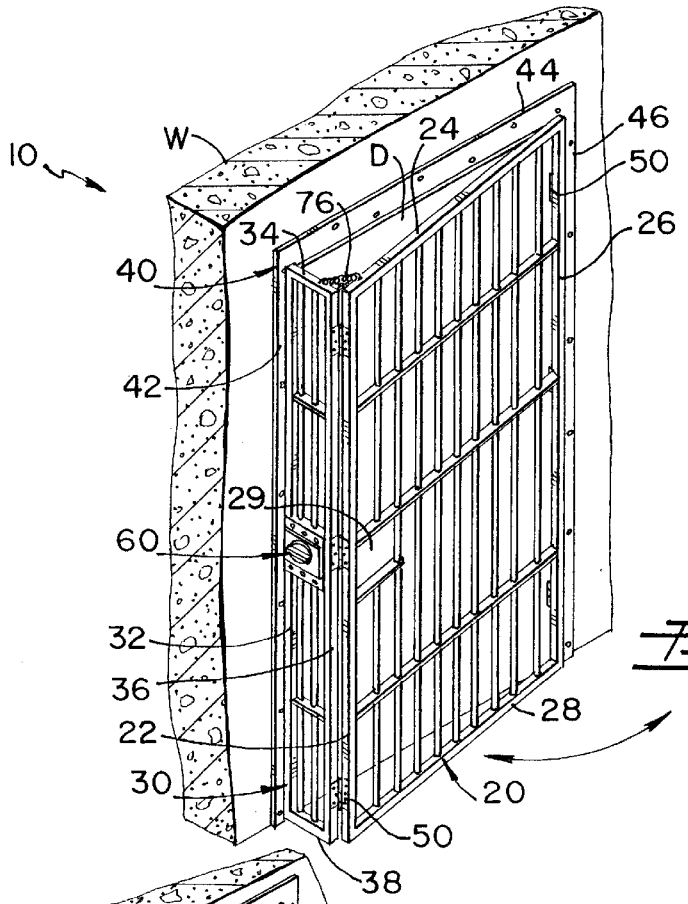
FIG. 1 represents an isometric view of the security door in the closed position.

Referring now to the drawings, where the present invention is generally referred to with numeral 10, it can be observed that it basically includes main panel 20, secondary panel 30, security casing assembly 40, and hinge assemblies 50 mounted to protect opening O in wall W.

As shown in FIG. 1, main panel 20 has substantially the same dimensions of the closure to be protected. In case the closure is a door D, it will have a rectangular shape with four sides 22; 24; 26 and 28. Sides 22 and 26 are disposed in a parallel and spaced apart relationship with respect to each other, in the same manner that sides 24 and 26 are also parallel to each other. Secondary panel 30 is smaller (narrower) than panel 20 and is hingedly mounted to the latter. Hinge assemblies 50 are mounted on side 22 of security panel 20 and on side 36 of panel 30 connecting them. Secondary panel 30 also includes sides 32; 34 and 38. As in panel 20, panel 30 has vertical sides 32 and 36 and horizontal sides 34 and 38. Sides 32 and 36 and sides 34 and 38 are disposed, respectively, in a parallel and spaced apart relationship with respect to each other.

Figure 2:
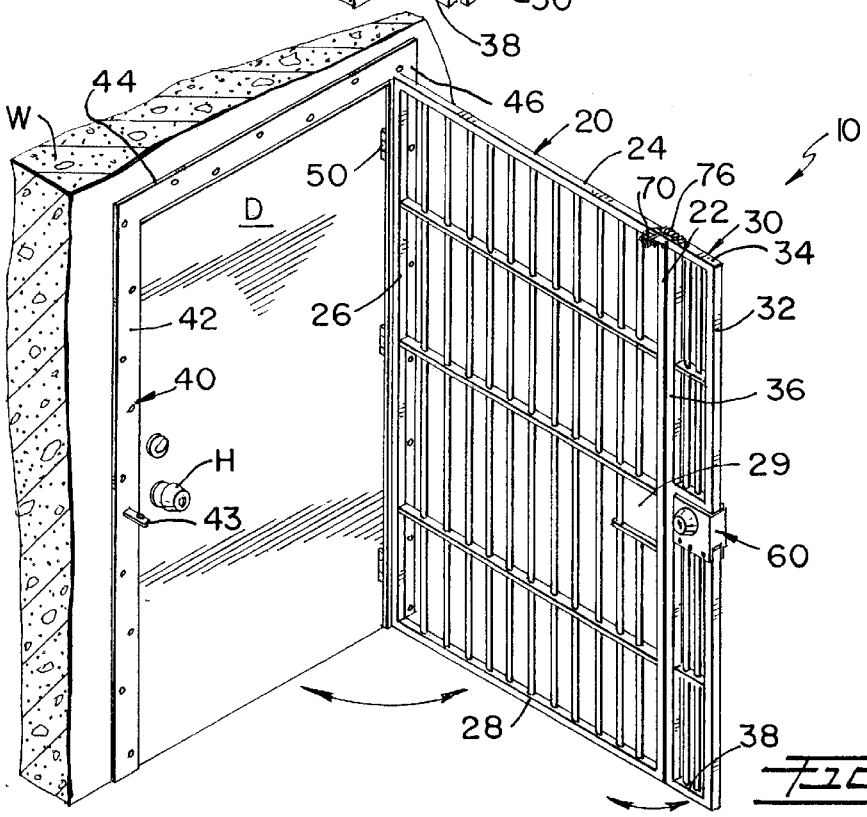
FIG. 2 shows an isometric view of one of the preferred embodiments for the present invention in the open position.
Figure 3:
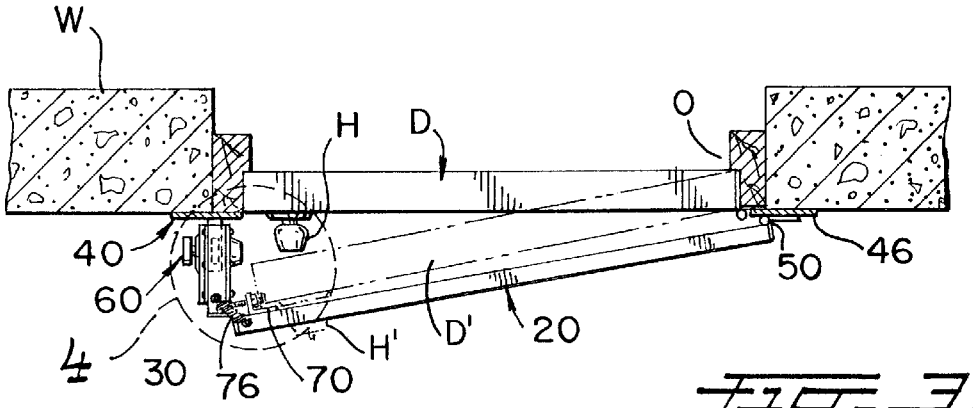
FIG. 3 illustrates top view of the present invention.

Panels 20 and 30 have a stronger constitution than the conventional closures (typical doors and windows) as seen in FIG. 2. They can be made out of iron bars or other equivalent materials to effectively protect door D. A clearance window 29 can be included in panel 20 to permit handle H of door D to go through when opening the door from the outside. This permits a user to access locking mechanism 60 as best seen in FIG. 3, and shown with letters D' and H' for the positions of the door and handle, respectively.

Locking mechanism 60 keeps side 32 releasably locked to side 42 of security casing assembly 40. Security casing assembly 40 also includes side 46 in a parallel and spaced apart relationship with respect to side 42 and side 44 that is perpendicularly and rigidly mounted to the upper ends of sides 42 and 46. Slotted tongue 43 protrudes from side 42 and is receivable within locking mechanism 60 to secure secondary panel 30 to casing assembly 40. Locking mechanism 60 is readily actuated from inside the building by anyone without requiring a key, combination or equivalent mechanism. Locking mechanism 60 is mounted to panel 30 and it can be locked and unlocked from the outside once door D is partially opened. Door D will open a distance substantially the same as the width of panel 30, allowing sufficient clearance for an authorized user to actuate locking mechanism 60.

Figure 4:
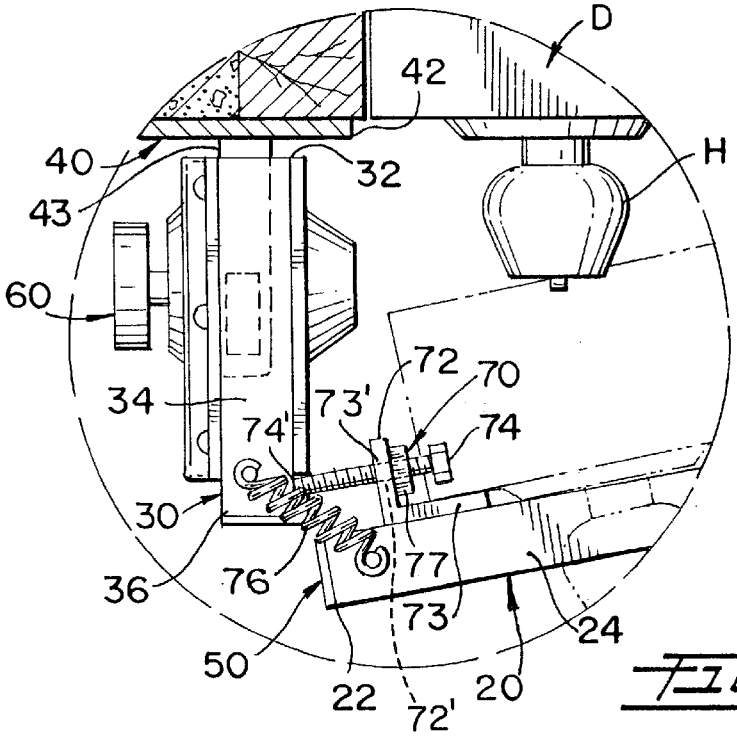
FIG. 4 is an enlarged detail view of the second panel taken along doted line 4 in FIG. 3.

It can be seen in FIG. 4 that stopper assembly 70 comprises anchor member 72 and fastening member 74 passing through. Anchor member 72 has a substantially L shape and leg 73 is rigidly mounted to the upper end of side 22. Fastening member 74 goes through threaded opening 72' of free leg 73' of anchor member 72. Nut 77 ensures that fastener member 74 stays in place. Spring member 76 urges panel 30 to a predetermined angular position relative to security panel 20 and the movement of panel 30 is limited by end 74' of fastening member 74. Spring member 76 helps to keep panels 20 and 30 in a predetermined angular position. This ensures that locking mechanism 60 is aligned to engage with tongue 43 when security door 10 is pulled to the close position.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A security closure device for openings in building walls where a closure member is hingedly mounted to said wall, comprising:

A) a casing assembly mounted to said walls and having first and second sides kept at a parallel and spaced apart relationship with respect to each other;

B) a first security panel having third and fourth sides and said third side being hingedly mounted to said first side and said security panel having cooperative dimensions substantially similar to said opening;

C) a second security panel having fifth and sixth sides that extend at a parallel and spaced apart relationship with respect to each other, said fifth side being hingedly mounted to said fourth side;

D) means for locking said sixth side to said second side, said means for locking being readily actuated from inside a building and requiring means for actuating said means for locking from outside the building.

2. The device set forth in claim 1 further including:

E) means for stopping said second security panel at a predetermined angular position relative to said first security panel so that said sixth side meets said second side at a predetermined location for cooperative engagement with said means for locking said sixth side to said second side.

3. The device set forth in claim 2 wherein the width of said second security panel is sufficient to provide access to a user to actuate said means for locking.

4. The device set forth in claim 3 wherein said closure member includes a handle that protrudes inwardly and said first security panel further includes a clearance window cooperatively positioned to permit said handle to go through when said closure member is moved inwardly and said sixth side is locked to said second side.

5. The device set forth in claim 4 further including:

F) means for urging said second security panel to said predetermined angular position.

* * * * *